US005253848A

United States Patent [19]

Saunders et al.

[11] Patent Number: 5,253,848

[45] Date of Patent: Oct. 19, 1993

[54] VALVE FOR MOLTEN METAL CONDUIT

[75] Inventors: Robert D. Saunders, Barboursville; William L. Mankins, Huntington, both of W. Va.

[73] Assignee: Inco Alloys International, Inc., Huntington, W. Va.

[21] Appl. No.: 897,685

[22] Filed: Jun. 12, 1992

[51] Int. Cl.[5] ..... B22D 35/04

[52] U.S. Cl. ..... 266/236; 222/597; 164/304

[58] Field of Search ..... 266/236; 222/597, 602; 164/337, 363, 304

[56] References Cited

U.S. PATENT DOCUMENTS 3,032,841 5/1962 Sylvester ..... 164/304
3,599,708 8/1971 Suzuki et al. ..... 164/337

FOREIGN PATENT DOCUMENTS 56-50652 11/1981 Japan .

*Primary Examiner*—Scott Kastler
*Attorney, Agent, or Firm*—Blake T. Biederman; Edward A. Steen

[57] ABSTRACT

A device for stopping flow of molten metal through a conduit having a longitudinal central passage. A ceramic seal is placed through a wall of a ceramic pipe for preventing flow of the molten metal through the opening in the wall of the ceramic pipe. A nonmetallic plug is located adjacent the ceramic seal. A lever arm adjacent the plug is used for depressing the ceramic seal and the nonmetallic plug vertically into the ceramic pipe through the longitudinal central passage to prevent flow of molten metal through the ceramic pipe.

14 Claims, 1 Drawing Sheet

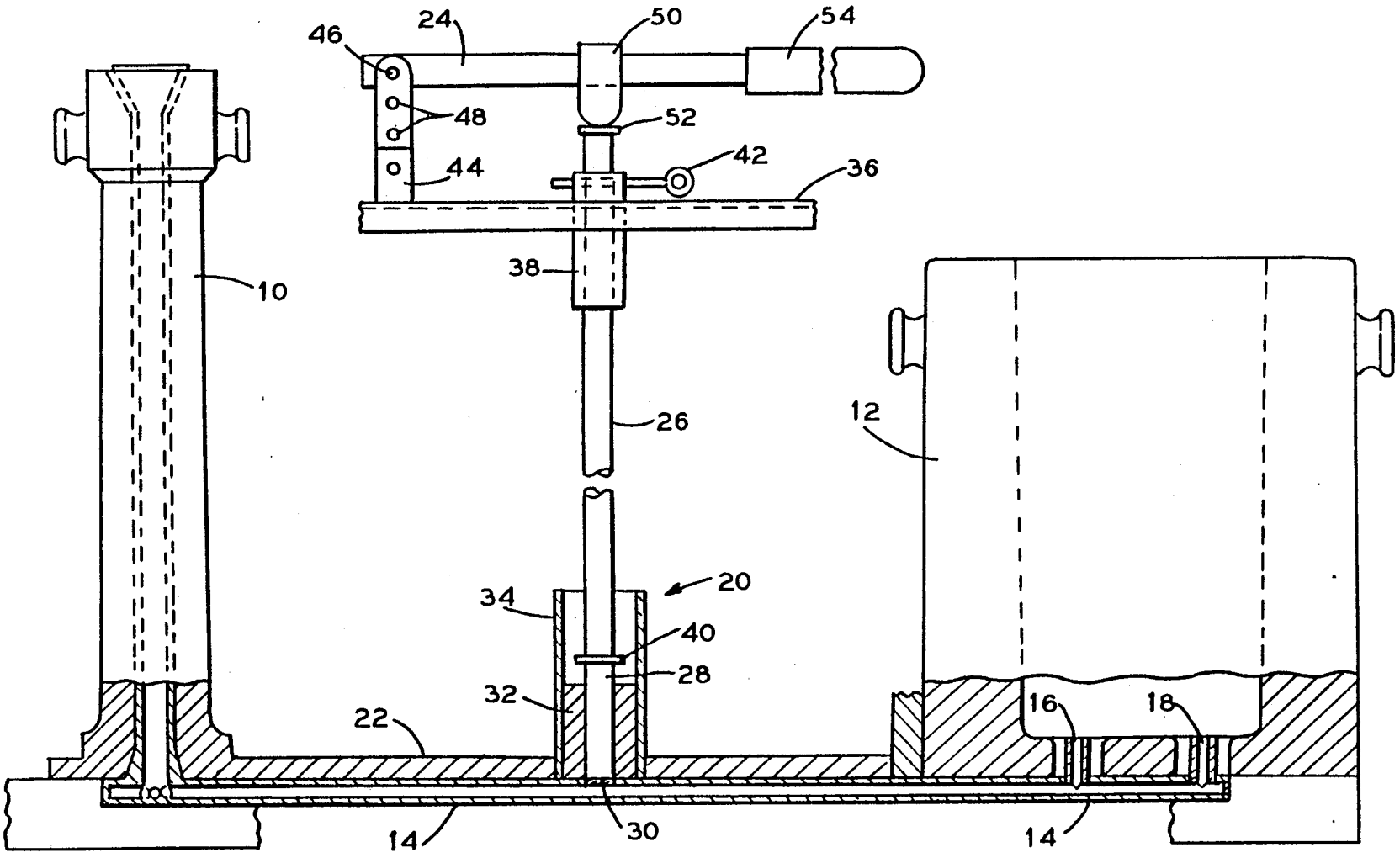
54
50
52
42
36
24
48
44
46
38
26
12
18
16
14
20
40
28
30
34
32
22
14
10

VALVE FOR MOLTEN METAL CONDUIT

FIELD OF INVENTION

This invention is related to the field of ceramic conduits used in distribution of molten metal. More particularly, this invention is related to a stop valve for allowing bottom pouring of ingots having different heights.

BACKGROUND OF THE INVENTION

Conventionally, molds have been directly poured from a ladle into an open top of an ingot mold. Ingot molds of different shapes and sizes would be poured for different applications. For example, a wide rectangular slab mold would be used to produce rectangular ingots for sheet production and a cylindrical mold would be used to produce cylindrical ingots for tube production. Top pouring of ingot molds slowly erodes side walls of the ingot mold. Repeated erosion in an ingot side wall eventually causes an ingot to stick in an ingot mold. Upon excess sticking of an ingot within a mold, the mold must be cut open to remove the ingot. After a mold is cut open, the mold must be scrapped and replaced with a new mold.

Recently, it has been discovered that bottom pouring of ingots triples the life of a mold by greatly reducing mold erosion arising from molten metal falling against the mold wall. Bottom pouring uses a common sprue connected by ceramic conduits to bottoms of several open top ingots. The problem with bottom pouring is that ingot molds of different heights may only be filled to a height of the lowest ingot mold.

A device for controlling bottom pouring of ingots having various heights is disclosed in Japanese Patent Publication No. 56-50652 ('652). The design of the '652 publication uses a hydraulic rod to push a refractory brick in front of an ingot inlet to prevent flow to a short height ingot. The refractory brick is pushed from a hydraulically power unit located around the perimeter of a pouring area through an end wall of a ceramic conduit. The brick of the '652 design is pushed longitudinally through a central passage of the central conduit to a location that blocks flow between the conduit and an opening in an ingot. The design of the '652 publication does not appear to be useful for molds having multiple inlet gates. In addition, the hydraulic units of the '652 publication appear to be prone to damage arising from run-outs and overhead crane operators.

It is an object of this invention to produce a valve that is useful for bottom pouring ingots having multiple inlets.

It is a further object of this invention to provide an apparatus and method less prone to damage from run-outs and overhead crane operators.

It is a further object of this invention to produce a quick and flexible setup for bottom pouring open top ingot molds having different heights.

SUMMARY OF THE INVENTION

The invention provides a device for stopping bottom pouring of molten metal through a conduit having a longitudinal central passage. A ceramic seal is placed in an opening in a wall of a ceramic pipe for preventing flow of the molten metal through the opening in the wall of the ceramic pipe. A nonmetallic plug is located adjacent the ceramic seal. A lever arm adjacent to the plug is used for depressing the ceramic seal and the nonmetallic plug vertically into the ceramic pipe through the longitudinal central passage to prevent flow of molten metal through the ceramic pipe.

BRIEF DESCRIPTION OF THE DRAWING

The FIGURE is a schematic view of a bottom pouring setup including a sprue, molten metal conduit, multiple opening ingot and gate for stopping flow of molten metal to the multiple opening ingot.

DESCRIPTION OF PREFERRED EMBODIMENT

The invention provides an improved method and apparatus for bottom pouring ingots of different heights from a common sprue. A gate placed in a location on one or more conduits between the sprue mold prevents continual flow of molten metal to an ingot mold. The gate operates by pushing a plug laterally into a conduit to effectively block flow of molten metal.

Referring to the FIGURE, sprue 10 is used to bottom fill short ingot mold 12 with molten metal by directing molten metal through conduit 14 and openings 16 and 18. Gate 20 is provided for stopping flow of molten metal through conduit 14. Conduit 14 is advantageously constructed of castable ceramic preforms that are supported by steel plate 22. Initially, during bottom pouring of ingots, metal flows uninterrupted from common sprue 10 through conduit 14 into openings 16 and 18 of ingot mold 12. Gate 20 provides the ability to stop flow to short ingot mold 12 when short ingot 12 is full while simultaneously continuing to fill a taller ingot mold. Gate 20 operates by depressing lever arm 24 which pushes vertical shaft 26 into plug 28 and seal 30. Advantageously, lever arm 24 has a length of at least 1 m to facilitate application of force on plug 28. Plug 28 is depressed laterally or orthoganally into conduit 14 to stop flow of molten metal in a location between sprue 10 and ingot 12. Most advantageously, plug 28 is depressed vertically into conduit 14 to provide an effective force against molten metal that is supported by the ground or floor structure. Seal 30 is advantageously constructed of a moldable ceramic material which completely lines the inner wall of conduit 14. Most advantageously, seal 30 is shaped to the internal dimensions of conduit 14 to prevent obstruction of flowing metal. As lever arm 24 is depressed, seal 30 is broken and plug 28 moves laterally in conduit 14 to block flow of metal.

Conduit 14 is most advantageously modified by adding an upwardly projecting extension of ceramic support section 32 supported by steel cylinder 34. Support section 32 acts as a sleeve to guide plug 28 into conduit 14. The spacing between support section 32 and plug 28 must be small enough to provide a seal upon eventual freezing of metal.

The selection of material for plug 28 is critical to the successful operation of gate 20. When a steel plug was used, the plug over-chilled the molten metal freezing the plug prior to blocking flow of molten metal. Over-chilling caused a film of metal between plug 28 and support section 32 to freeze with sufficient strength to prevent plug 28 from being forced into the channel of conducit 14. It has been discovered that when plug 28 is constructed of a nonmetallic material, over-chilling is not a problem. Advantageously, plug 28 is selected from the group consisting of carbon, graphite and ceramic. Most advantageously, a reusable graphite plug is used that may be chipped away from mold metal after cooling. Advantageously, plug 28 is constructed of a circular cross-section and a flat bottom. Most advantageously, conduit 14 is specifically shaped to receive a cylindrically shaped plug. Furthermore, clearance between the plug and the conduit is advantageously less than 1 mm to prevent bypassing of molten metal. The seal material also aids in stopping the flow of metal. Optionally, metal shot (not illustrated in FIG. 1) may be placed above section 32 to provide a safety mechanism to freeze leaks between plug 28 and section 32. In test operations, it has been found that steel shot is not required.

Advantageously, support base 36 is used to support lever arm 24. Support base 36 is preferably constructed out of a U-shaped steel beam. Alternatively, any support structure may be used to support shaft 26. Most advantageously, guide 38 is used to position shaft 26 in a vertical position. Guide 38 may extend the entire length of shaft 26 to provide additional stiffening. If additional structural support is required, a steel beam may be connected between steel cylinder 34 and support base 36. Advantageously, driver disk 40 is used to ensure alignment between plug 28 and shaft 26. Pin 42 is optionally used to prevent premature fracture of seal 30. Pin 42 is preferably positioned high on shaft 26 to facilitate access from a walkway above ingots. Advantageously, a rope or wire may be connected to pin 42 for removing pin 42 from a remote location.

An adjustable pivot base 44, mounted on support base 36, provides a pivotable connection for lever arm 24. Lever arm 24 rotates around pivot bolt 46. Pivot bolt 46 may be placed through various adjustment holes 48 to ensure that driver structure 50 aligns properly with receiving surface 52. Most advantageously, cylindrical extension 54 is used to provide additional downward force. Most advantageously, extension 54 extends to a walkway position above the height of the lowest ingot to be poured to allow an operator to visually determine when the lowest ingot is full. For example, extension 54 may extend about 3 meters upwardly so that flow of metal to ingots may be visually monitored and controlled from a walkway above all ingots.

For systems having multiple ingots of varied heights a gate may be placed on each runner conduit that leads to an ingot. Furthermore, one gate may be used to stop flow to two or more ingots connected by a single runner conduit. Alternatively, a shaft may be divided with a horizontal splitter to simultaneously operate two gates by depressing two plugs simultaneously into a conduit. A horizontal splitter arrangement is especially effective for simultaneously blocking flow of metal through two radially extending conduits.

In summary, the gate design of the invention provides several advantages for bottom pouring operations. The design of the invention provides a single gate that may be used with ingots having multiple inlets. The gate provides a quick, flexible and reusable device for simplified bottom pouring open top ingot molds having different heights. The plug of the gate travels a relatively short distance prior to blocking flow of molten metal. Furthermore, the distance a plug is depressed to prevent flow remains constant and is directly proportional to the diameter of conduit used and is not related to the size, shape or type of ingot mold used. Finally, the apparatus of the invention provides a gate less prone to damage from run-outs and overhead crane operators.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

The embodiments of the invention in which an exclusive property or privilege is claimed are defined as follows:

1. A device for stopping bottom pouring of molten metal into an ingot mold having a height less than another ingot mold connected to a single conduit network comprising:

a ceramic conduit having a longitudinal central passage directed to the ingot mold of lesser height;

a ceramic breakaway seal placed in an opening in a wall of said ceramic conduit for preventing the molten metal from flowing through said opening in said wall of said ceramic conduit;

a nonmetallic plug adjacent said ceramic seal; and a means for breaking said seal and pushing said nonmetallic plug orthoganally into said longitudinal central passage into said ceramic conduct to prevent flow of molten metal through said ceramic conduit into the ingot mold of lesser height.

2. The device of claim 1 wherein said means for breaking said ceramic seal and pushing said nonmetallic conduit into the ceramic conduct includes a lever arm.

3. The device of claim 2 wherein a removable pin is connected to said means for pushing said ceramic seal and said nonmetallic plug and wherein said pin prevents premature application of said lever arm.

4. The device of claim 1 wherein said nonmetallic plug is constructed from a material selected from the group consisting of carbon, glass and ceramic.

5. The device of claim 1 wherein said nonmetallic plug is constructed of a reusable graphite cylinder.

6. The device of claim 1 wherein said means for breaking said ceramic seal and pushing said nonmetallic plug includes a vertical shaft for operating the device at a location where height of metal in the ingot mold of lesser height is visually determinable.

7. The device of claim 1 wherein said nonmetallic plug is surrounded by a ceramic sleeve.

8. A device for stopping bottom pouring of molten metal into an ingot mold having a height less than another ingot mold connected to a single pipe network comprising:

a ceramic pipe having a longitudinal central passage directed to the ingot mold of lesser height;

a ceramic breakaway seal placed in an opening in a top wall of said ceramic pipe for preventing the molten from flowing through said opening in said top wall of said ceramic pipe;

a nonmetallic plug above said ceramic seal;

a vertical elongated shaft above said ceramic seal and said non-metallic plug; and a lever arm for pushing said shaft for breaking said ceramic seal and pushing said nonmetallic plug vertically into said ceramic pipe through said longitudinal central passage to prevent flow of molten metal through said ceramic pipe into the ingot mold of lesser height.

9. The device of claim 8 wherein said means for breaking said ceramic seal and pushing said nonmetallic plug into the ceramic plug includes a lever arm having a length of at least 1 m.

10. The device of claim 9 wherein a removable pin is connected to said means for pushing said ceramic seal and said nonmetallic plug and wherein said pin prevents premature fracture of said ceramic seal.

11. The device of claim 9 wherein said nonmetallic plug is constructed from a material selected from the group consisting of carbon, glass and ceramic.

12. The device of claim 8 wherein said nonmetallic plug is constructed of a reusable graphite cylinder.

13. The device of claim 8 wherein said nonmetallic plug is surrounded by a sleeve.

14. The device of claim 9 wherein said nonmetallic plug has a bottom portion shaped to block flow of molten through said ceramic pipe.

* * * * *